US005142194A

United States Patent [19]

Jacubeit et al.

[11] Patent Number: 5,142,194

[45] Date of Patent: Aug. 25, 1992

[54] SPARK GAP COMPONENT OF PARTICULAR SPACING MOUNTED WITHIN A SHIELD

[75] Inventors: Matthias Jacubeit; Tetsuo Fukumoto; Juergen Boy, all of Berlin, Fed. Rep. of Germany

[73] Assignee: Siemens Aktiengesellschaft, Berlin & Munich, Fed. Rep. of Germany

[21] Appl. No.: 467,031

[22] Filed: Jan. 18, 1990

[30] Foreign Application Priority Data

Jan. 18, 1989 [EP] European Pat. Off. ..... 89730009

[51] Int. Cl.[5] ..... H01T 13/00

[52] U.S. Cl. ..... 313/603; 313/601

[58] Field of Search ..... 313/594, 601, 602, 603, 313/308; 361/117, 118, 120

[56] References Cited

U.S. PATENT DOCUMENTS 3,956,657 5/1976 Siegle ..... 313/214
3,989,973 11/1976 Lange et al. ..... 313/594
3,995,183 11/1976 Lechner et al. ..... 313/124
4,475,055 10/1984 Boettcher ..... 313/54
4,578,733 3/1986 Shigemori et al. ..... 361/120
4,631,453 12/1986 DeSouza et al. ..... 315/340
4,739,439 4/1988 Boy ..... 313/602 X

FOREIGN PATENT DOCUMENTS 0099522 2/1987 European Pat. Off. .
2418261 5/1976 Fed. Rep. of Germany .

*Primary Examiner*—Donald J. Yusko
*Assistant Examiner*—John Giust
*Attorney, Agent, or Firm*—Kenyon & Kenyon

[57] ABSTRACT

In order to ensure that the ignition voltage does not depend on whether a sark gap component is shielded or unshielded, a ring-shaped control electrode that makes electrical contact with the electrode not at ground potential is mounted adjacent to or on to the outer circumference of the insulator at an axial level almost equal to that of the active surface of the electrode not at ground potential. The control electrode comprises of either a metallic coating, a band-shaped strip, or a metal cap.

13 Claims, 2 Drawing Sheets

SPARK GAP COMPONENT OF PARTICULAR SPACING MOUNTED WITHIN A SHIELD

BACKGROUND OF THE INVENTION

This invention relates to electric components in general and more particularly, to the construction of a spark gap component, that, during operation, is mounted within a protective shield that surrounds it. The spark gap component and the protective shield are separated by a solid dielectric. These spark gap components are used as auxiliary spark gaps for spark plugs, particularly in motor vehicles.

A spark gap component known in the art comprises a tubular insulator and two electrodes, with one electrode mounted in a vacuum-tight manner on one end of the insulator, and the second electrode mounted on the other end of the insulator. When in operation, one electrode has a potential different from ground while the other electrode has a potential near that of ground. Both of the electrodes have an essentially flat active surface. These flat surfaces are provided with a layer of fire-resistant material. This spark gap component is used in a spark plug connector. In its assembled state, the component is located within a bore in an insulating body that is covered by a metallic shield. The ignition voltage of the spark gap component is approximately 8 to 10 kV, as disclosed in DE-B-24 18 261.

Other spark gap components that have been designed for even higher ignition voltages are known in the art. In order to ensure, among other things, the long-term stability of the ignition voltage when it is in the range of 2 to 16 kV, the active parts of the electrodes are made of titanium, zirconium and similar metals, and the spark gap component is filled with an inert gas at a pressure of 0.8 to 10 bar, as disclosed in U.S. Pat. No. 3,956,657. In order to increase the ignition voltage to 18 kV, as well as for other reasons, another spark gap component known in the art provides an ignition aid that is attached to the inner wall of the insulator near the discharge gap. The sum of the spacings of the ignition aid from the rounded or bevelled electrode edges is greater than the spacing between the electrodes and is approximately 0.5 mm. This component, designated as an auxiliary spark gap, is essentially filled with nitrogen at a pressure of approximately 15 bar, as disclosed in EP-C-0 099 522.

It has been discovered that when using auxiliary spark gaps which have an ignition voltage increased to the range of 15 to 25 kV, which are then shielded, the ignition voltage deviates from and is considerably less than when the auxiliary spark gaps are unshielded.

In view of this discovery, there is a need for a spark gap component in which the ignition voltage is essentially independent of whether or not the spark gap component is subsequently shielded. In particular, when the spark gap component is shielded, the ignition voltage should not be considerably less than the ignition voltage when the spark gap component is not shielded.

SUMMARY OF THE INVENTION

According to the present invention, this task is accomplished by providing a ring-shaped control electrode, for the purpose of controlling the voltage, which makes electrical contact with the electrode not at ground potential, and which is mounted adjacent to or on the outer circumference of the insulator at an axial level almost equal to that of the active surface of the electrode not at ground potential. The invention takes into account the observation that as increasingly larger ignition voltages are used, the electric field between both electrodes of the spark gap component is influenced by the surrounding shield in such a way that the magnetic force increases on the circumferential edge of the active surface of the electrode not at ground potential. As a result, the ignition voltage is reduced. However, by using the control electrode according to the invention, the electric field is influenced so that no considerable difference is exhibited in the value of the ignition voltage whether the spark gap component is shielded or unshielded.

According to the invention, the effectiveness of the voltage control depends on, among other things, the distance between the shield and the spark gap component, and particularly on the distance between the electrodes and the shield. The effectiveness of the voltage control also depends on the spacing in the axial direction between the effective edge of the control electrode and the active surface of the electrode not at ground potential. The smaller the gap between the shield and the spark gap component, the more precisely located must be the position of the control electrode. It has proven practical to select the axial distance between the control electrode and the active surface of the electrode to which it is electrically connected so that it is at most 10% of the minimum distance between the active surfaces of both electrodes. It is advantageous that the control electrode be constructed of metal. It may, for example, consist of a galvanically-applied metallic coating or a conducting layer of fluid silver that is painted on. However, a wire ring, a band-shaped ring with a band width of at least 1 mm, or a metal cap extending down to the base of the appropriate electrode, may also be provided. These control electrodes can be attached to the corresponding electrode by soldering, for example. The arrangement of a single control electrode that is only in electrical contact with the electrode not at ground potential is only meaningful when the shield is fixed at ground potential. If the shield is at a floating potential, it is necessary to provide a control electrode to both electrodes. However, this is also possible if the shield is grounded.

DETAILED DESCRIPTION

Figure 1:
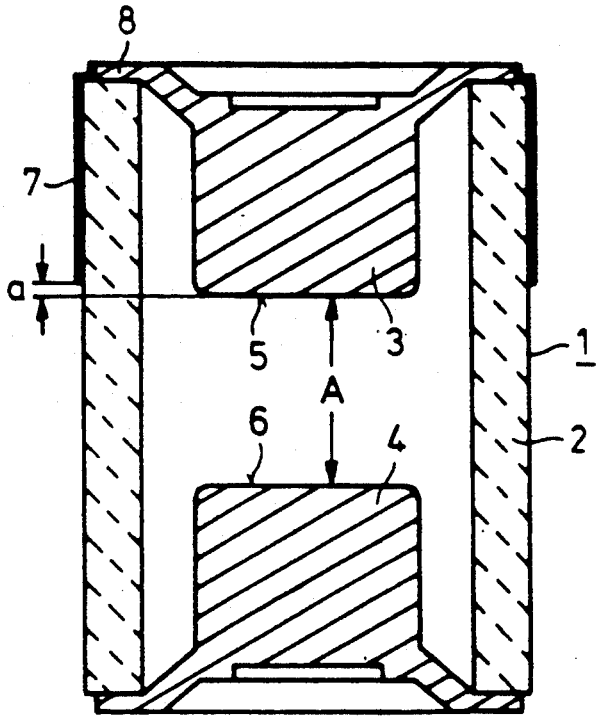
FIG. 1 shows a spark gap component in which a control electrode is assigned only to the electrode not at ground potential according to the construction of the present invention.

FIG. 1 shows a spark gap component 1 that includes a tubular glass or ceramic insulator 2 and electrodes 3 and 4. The electrodes have active surfaces 5 and/or 6. The active surfaces are separated from each other by a gap A of approximately 6 mm.

A cylindrical control electrode 7 extends axially toward the electrode 4 from the base 8 of the electrode 3, along the outer circumference of the tubular insulator 2, and ends at an axial level almost equal to that of the active surface 5 of the electrode 3. The axial distance between the end of the control electrode and the active surface of the electrode 3 is a. This distance a is less than 10% of the width of gap A and equals approximately 0.5 mm. Control electrode 7 makes electrical contact with the electrode 3. The control electrode 7 consists of an applied metallic coating made of a metal-silicate mixture.

Figure 3:
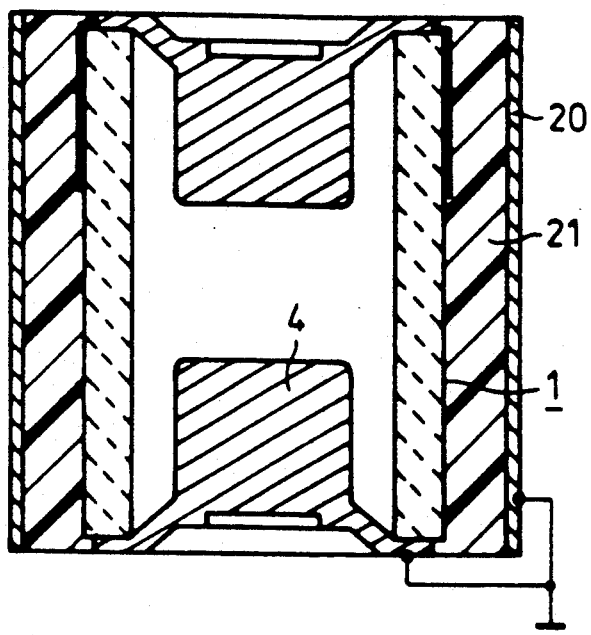
FIG. 3 shows a spark gap component according to FIG. 1 with a shield that is in electrical contact with the electrode near ground potential.

When the spark gap component 1 of FIG. 1 is installed in a grounded shield, care must be taken that the electrode 3 is the electrode not at ground potential and that electrode 4 is connected directly, or via a resistor, to the shield. FIG. 3 shows an example of this construction in which the spark gap component 1 is surrounded by a solid dielectric 21 and a shield 20. The electrode 4 is electrically connected to the shield 20.

Figure 2:
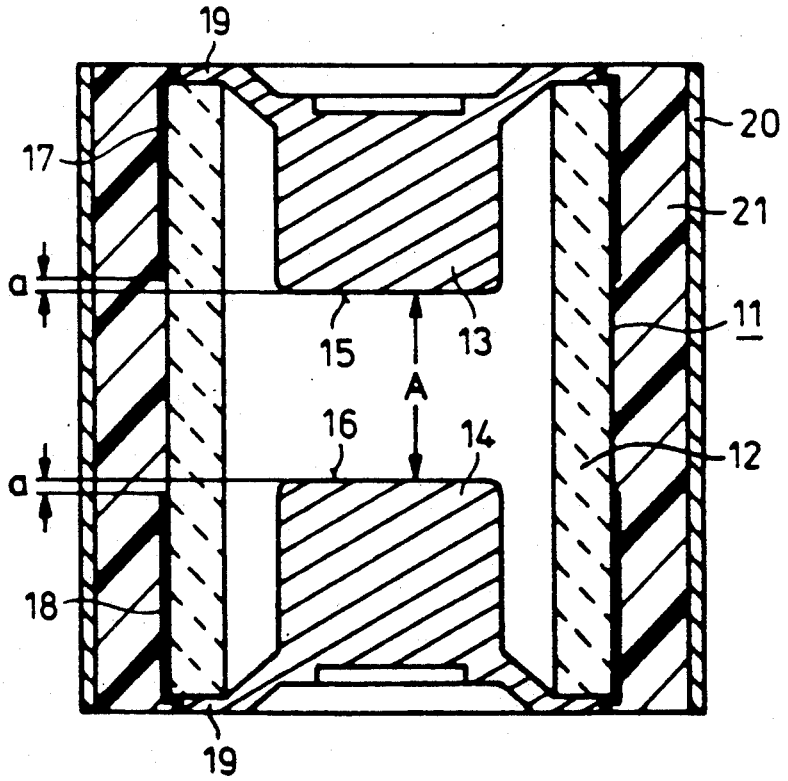
FIG. 2 shows a spark gap component that is mounted within a shield at a floating potential in which one control electrode is assigned to each electrode.

FIG. 2 shows a spark gap component 11 within a shield 20, in which the space between the shield 20 and the component 11 is filled with a solid dielectric 21. The solid dielectric 21 maybe an insulating plastic, for example a shrink tube.

The spark gap component 11 includes the tubular insulator 12, into which both electrodes 13 and 14 are inserted. The active surfaces 15 and 16 of both electrodes are separated by a gap A, just as in FIG. 1. Each electrode is assigned a control electrode 17 or 18, which extends axially toward the opposite electrode from the base 19 of its respective electrode and ends at an axial level almost equal to that of the active surface of its respective electrode. The shield 20 is not maintained at any specific potential. The control electrodes 17 and 18 each consist of metallic tubular pieces that are soldered at one end to the base of its respective electrode. The control electrodes may also be in the form of a cap, whereby the cap has a suitable hole in its base in order to directly make contact with its respective electrode.

Figure 4:
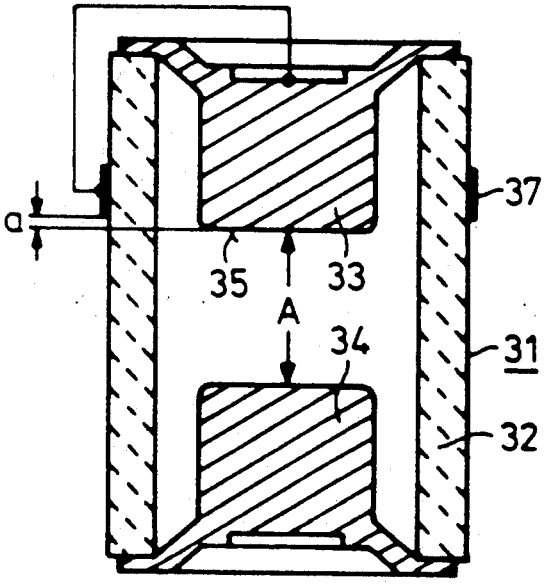
FIG. 4 shows a spark gap component with a control electrode in the form of a band-shaped ring.

FIG. 4 shows a spark gap component 31 that includes control electrode 37 in the form of a band-shaped ring with a band-width of approximately 2 mm, which is mounted on the outer surface area of the insulator 32. The control electrode 37 is at almost the same axial level as the active surface 35 of the electrode not at ground potential 33. This band-shaped ring is electrically connected to the electrode 33. Its edge, which faces the electrode 34 and is used to control the voltage, is the same axial distance from the active surface of the electrode 33 as are the control electrodes in FIGS. 1 and 2.

Figure 5:
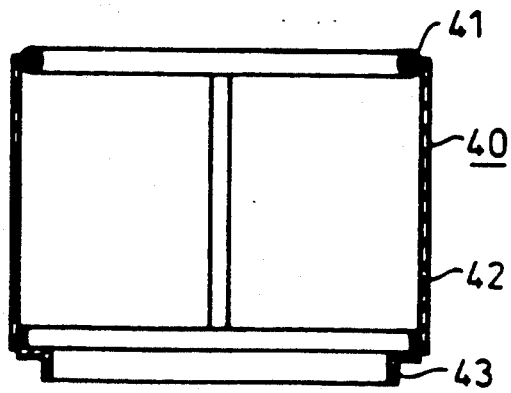
FIG. 5 shows a control electrode in the form of a wire ring.

FIG. 5 shows a control electrode 40, which consists mainly of a wire ring 41 with a diameter of approximately 0.5 to 1 mm that is supported by supporting elements 42 which are on a base ring 43. The base ring 43 of this control electrode 40 can be connected to the base of an electrode of a spark gap component and they can be soldered together if applicable.

What is claimed is:

1. In a spark gap component to be mounted such as to be surrounded by a shield at ground potential, the spark gap component including a solid dielectric tubular insulator and two electrodes each having a primarily flat active surface, one of the two electrodes not at ground potential mounted on a first end and an other of the two electrodes mounted on a second end of the insulator, the improvement comprising, a first ring-shaped control electrode associated with and electrically connected to the electrode not at ground potential mounted next to or one to the outer surface area of the insulator near the level of the active surface of the one electrode not at ground potential so that an ignition voltage does not substantially decrease when said spark gap component is surrounded by said shield, said level defining a vertical clearance between said first control electrode and the active surface of its associated electrode equal to at most 10% of the smallest distance between the active surfaces of said two electrodes.

2. The spark gap component according to claim 1, wherein said control electrode comprises a metallic coating.

3. The spark gap component according to claim 1, wherein said control electrode comprises a metal cap.

4. The spark gap component according to claim 1, wherein said control electrode comprises a band-shaped ring with a band width of at least 1 mm.

5. The spark gap component according to claim 4, wherein said control electrode extends to the base of its associated electrode.

6. The spark gap component according to claim 1, and further including a second ring-shaped control electrode similarly associated and mounted with respect to the other electrode.

7. The spark gap component according to claim 6, wherein at least one of said control electrodes extends to the base of its associated electrode.

8. The spark gap component according to claim 6, wherein at least one of said control electrodes comprises a metallic coating.

9. The spark gap component according to claim 6, wherein at least one of said control electrodes comprises a metal cap.

10. The spark gap component according to claim 6, wherein said control electrode comprises a band-shaped ring with a band width of at least 1 mm.

11. The spark gap component according to claim 10, wherein said control electrode extends to the base of its associated electrode.

12. The spark gap component according to claim 6, wherein at least one of said control electrodes comprises a band-shaped ring with a band width of at least 1 mm.

13. The spark gap component according to claim 12, wherein at least one of said control electrode extends to the base of its associated electrode.

* * * * *